US011192771B2

(12) United States Patent
Wolter et al.

(10) Patent No.: US 11,192,771 B2
(45) Date of Patent: Dec. 7, 2021

(54) TAP HEAD HAVING A 3/2-WAY VALVE

(71) Applicant: DSI GETRAENKEARMATUREN GMBH, Hamm (DE)

(72) Inventors: Mirco Wolter, Welver (DE); Rudolf Klemm, Welver (DE); Stefan Sueltrop, Erwitte (DE)

(73) Assignee: DSI GETRAENKEARMATUREN GMBH, Hamm (DE)

( * ) Notice: Subject to any disclaimer, the term of this patent is extended or adjusted under 35 U.S.C. 154(b) by 0 days.

(21) Appl. No.: 16/962,471

(22) PCT Filed: Sep. 13, 2018

(86) PCT No.: PCT/DE2018/100780
§ 371 (c)(1),
(2) Date: Jan. 29, 2021

(87) PCT Pub. No.: WO2019/080958
PCT Pub. Date: May 2, 2019

(65) Prior Publication Data

US 2021/0139306 A1 May 13, 2021

(30) Foreign Application Priority Data

Oct. 27, 2017 (DE) ..... 10 2017 125 248.7
Dec. 14, 2017 (DE) ..... 10 2017 129 912.2

(51) Int. Cl.
*B67D 1/08* (2006.01)

(52) U.S. Cl.
CPC ..... *B67D 1/0832* (2013.01); *B67D 1/0838* (2013.01)

(58) Field of Classification Search
CPC ..... B67D 1/0838; B67D 1/0832
(Continued)

(56) References Cited

U.S. PATENT DOCUMENTS 595,112 A 12/1897 Posgay
2,070,517 A * 2/1937 O'Leary ..... B67D 1/04 137/207.5
(Continued)

FOREIGN PATENT DOCUMENTS

CN 203513254 U 4/2014
EP 3028988 A1 6/2016
(Continued)

OTHER PUBLICATIONS

Examination Report for Indian Application No. 202047030843 dated Apr. 19, 2021; 6pp.
(Continued)

*Primary Examiner* — Paul R Durand
*Assistant Examiner* — Michael J. Melaragno
(74) *Attorney, Agent, or Firm* — Hauptman Ham, LLP

(57) ABSTRACT

The disclosure relates to a tap head for connecting to a keg for a bar system, the tap head having a tap head body, and a pressurization-gas supply line and a beverage removal line being formed in the tap head body, such that a 3/2-way valve is formed directly on or in the tap head body in the pressurization-gas supply line, which 3/2-way valve connects either the pressurization-gas supply line from a gas source to the interior of the keg or connects, in a gas-conducting manner, the interior of the keg to the environment.

12 Claims, 7 Drawing Sheets

(58) Field of Classification Search
USPC ..... 222/400.7
See application file for complete search history.

(56) References Cited

U.S. PATENT DOCUMENTS

| | | | | | |
|---|---|---|---|---|---|
| 2,076,262 | A * | 4/1937 | Black | F02B 77/04 | 134/102.2 |
| 2,925,828 | A * | 2/1960 | Lieser | F16K 11/07 | 137/625.26 |
| 3,072,208 | A * | 1/1963 | Titchenal | B65B 1/18 | 177/71 |
| 3,353,724 | A * | 11/1967 | Johnston | B67D 1/0832 | 222/400.7 |
| 3,908,871 | A | 9/1975 | Gottwald | | |
| 4,125,209 | A * | 11/1978 | Bailey | B67D 1/0832 | 137/212 |
| 4,137,954 | A * | 2/1979 | Brill | B67D 1/0832 | 137/864 |
| 4,159,102 | A * | 6/1979 | Fallon | B67D 1/0832 | 137/212 |
| 4,181,143 | A * | 1/1980 | Fallon | B67D 1/0832 | 137/212 |
| 4,228,927 | A * | 10/1980 | Beyens | B08B 9/0804 | 134/166 C |
| 4,291,821 | A * | 9/1981 | Nezworski | B67D 1/0832 | 137/212 |
| 4,305,421 | A * | 12/1981 | Fallon | B67D 1/0832 | 137/212 |
| 4,341,240 | A * | 7/1982 | Cerrato | B67D 1/0832 | 137/533 |
| 4,436,228 | A * | 3/1984 | Frey | B67D 1/0832 | 222/400.7 |
| 4,450,853 | A * | 5/1984 | Dessenoix | B67D 1/0832 | 137/212 |
| 4,538,746 | A * | 9/1985 | Hines | B67D 1/0832 | 137/322 |
| 4,736,926 | A * | 4/1988 | Fallon | B67D 1/0832 | 137/212 |
| 5,176,298 | A * | 1/1993 | Mogler | B67D 1/0831 | 222/400.7 |
| 5,617,977 | A * | 4/1997 | Augustinus | B67D 1/0832 | 222/400.7 |
| 5,690,136 | A * | 11/1997 | Celli | B67D 1/0832 | 137/212 |
| 6,315,172 | B1 * | 11/2001 | Till | B67D 1/0832 | 222/400.7 |
| 6,367,667 | B1 * | 4/2002 | Ipsen | B67D 1/0832 | 137/212 |
| 8,757,195 | B2 * | 6/2014 | Gitlin, Jr. | B67D 1/0831 | 137/317 |
| 2002/0050498 | A1 * | 5/2002 | Celli | B67D 1/0839 | 222/400.7 |
| 2002/0074352 | A1 * | 6/2002 | Till | B67D 1/0837 | 222/148 |
| 2003/0075566 | A1 * | 4/2003 | Priebe | B67D 7/0261 | 222/318 |
| 2004/0045988 | A1 * | 3/2004 | van der Klaauw | B67D 1/0832 | 222/400.7 |
| 2010/0181346 | A1 * | 7/2010 | Hanssen | B67D 1/0831 | 222/400.7 |
| 2010/0243676 | A1 * | 9/2010 | Bax | B67D 1/07 | 222/148 |
| 2010/0308084 | A1 * | 12/2010 | Riis | B67D 1/07 | 222/400.7 |
| 2012/0248139 | A1 * | 10/2012 | Haskayne | B67D 1/1411 | 222/1 |
| 2014/0124543 | A1 * | 5/2014 | Dahl | B67D 1/0848 | 222/400.7 |
| 2016/0137478 | A1 * | 5/2016 | Riis | B67D 1/0878 | 222/47 |
| 2017/0267511 | A1 * | 9/2017 | Valles | B67D 1/0004 | |

FOREIGN PATENT DOCUMENTS

| | | |
|---|---|---|
| RU | 2381174 C1 | 2/2010 |
| WO | 9952814 A1 | 10/1999 |

OTHER PUBLICATIONS

Search Report of Russian Application No. 2020123564 dated Mar. 12, 2021; 17pp.

* cited by examiner

TAP HEAD HAVING A 3/2-WAY VALVE

RELATED APPLICATIONS

The present application is a National Phase of International Application Number PCT/DE2018/100780 filed Sep. 13, 2018 and claims priority to German Application Numbers 10 2017 129 912.2 filed Dec. 14, 2017 and 10 2017 125 248.7 filed Oct. 27, 2017.

FIELD

The present disclosure relates to a tap head for connecting to a keg.

For the purposes of dispensing beverages, from the prior art it is known first of all to prepare these beverages in a keg and then to extract them from this keg. This process is also known colloquially as tapping. Such tapping of beverages occurs in carbonated beverages. These are usually beer, carbon dioxide-containing soft drinks, and the like.

BACKGROUND

In this case, the beverage itself is prepared in a keg. The keg arrives at the bar location from a brewery or a keg-filling station in a closed condition. If the keg is positioned in its intended setup location, a tap head is attached to/hammered into the keg and the beverage in the keg can be extracted. To this end, the tap head has a pressurisation-gas supply line, so that a pressurisation gas prepared, for example, in a gas bottle is introduced into the keg, the keg is thereby subjected to pressure and the beverage exits from the keg via a rising line. CO2 is usually used as the pressurisation gas.

In addition to kegs of metallic materials, e.g., aluminium kegs, recently more and more "single-use" kegs have gained a foothold in the market. Single-use kegs are as a rule made of plastics and are not re-used after the single use, but are disposed of. However, there are also multiple-use plastic kegs. If the keg is nearly empty, it is exchanged for a full one. However, the keg is still in a pressurised condition from the introduced pressurisation gas.

From DE 43 16 457 C1 a pressure-release valve is known to be incorporated in a tap head, which valve is, however, only actuated once the operation to release the tap head has started. But in the case of single-use kegs, with this arrangement even the actual keg closure can be gas-tightly closed so that, although some of the pressurisation gas present escapes, the keg itself remains under an undesirable residual pressure. This residual pressure exceeds the ambient pressure.

SUMMARY

The aim of the present disclosure is to propose a method of completely degassing a keg, e.g., a single-use keg, wherein the user can see without further testing that the degassing function has been carried out.

Various exemplary embodiments are the subject of the dependent claims.

The tap head is suitable for connecting to or positioning on a keg, e.g., for a bar system, wherein the tap head itself has a tap-head body and a pressurisation-gas supply line and a beverage draw line are formed in the tap-head body. As a rule the tap-head body is made of a metallic material. A push tube may optionally also be present in the tap-head body, and a pivoted lever coupled to the tap-head body. When attaching the tap head to the keg, the tappet can then be displaced in an axial direction by the pivoted lever.

According to the disclosure, the tap head is characterised in that a 3/2-way valve is formed directly on or in the tap-head body in the pressurisation-gas supply line, which 3/2-way valve, when the tap head is attached and locked, either connects the pressurisation-gas supply line from a gas source to the interior chamber of the keg, or connects, in a gas-conducting manner, the interior chamber of the keg to the environment. Within the meaning of the disclosure, a 3/2-way valve thus has three connectors and two switching positions.

Due to the 3/2-way valve it is therefore possible to assume two positions, i.e. two settings. The keg is either connected to the gas source in a gas-conducting manner. Operation of the tap or bar can therefore take place. If the keg has to be exchanged or swapped, for example because it is empty or because a technical defect has arisen, or if cleaning is necessary, the 3/2-way valve may be moved to a position according to which the interior chamber of the keg is connected to the environment in a gas-conducting manner, but at the same time further supply of pressurisation gas from the gas source is blocked. This is to ensure that the interior pressure in the keg is discharged or falls to the ambient pressure. The keg could thus be disposed of without risk. There therefore remains no residual pressure in the keg itself. For example, escape of liquids when the tap head is removed is thus avoided. When used on a single-use keg, the single-use keg may be disposed of without residual pressure.

The fact that the 3/2-way valve is coupled directly to the tap-head body or integrated into the tap-head body increases operational safety. The tap head itself is removed from the keg, so that a user always also has direct access to the 3/2-way valve on the tap head.

The present disclosure thus also relates to an arrangement comprising a keg, a tap head, a gas bottle and a tap, as well as the respective component-connecting lines, and to use of a tap head according to the disclosure with 3/2-way valve, and to a method for operating a bar system.

The 3/2-way valve is designed as a slide valve, or the 3/2-way valve is designed as a rotary valve. The 3/2-way valve is coupled either to the tap-head body itself, coupled with positive fit, and connected using a driven-screw technique. In another exemplary embodiment, the 3/2-way valve may also be retro-fitted to tap heads already present or, in the event of wear or defect, the 3/2-way valve may simply be exchanged without the whole tap head having to be exchanged. The individual components of the 3/2-way valve may be made of metallic material, for example brass or stainless steel, but at least partially also of plastic.

The 3/2-way valve may however also be designed of a piece with and of the same material as the tap-head body itself. The 3/2-way valve may thus be integrated into the pressurisation-gas supply line of the tap-head body itself. This may be achieved, for example, in a casting or forging process during manufacture of the tap-head body.

In another exemplary embodiment, within the framework of the disclosure, the 3/2-way valve is in the form of a slide valve. In this arrangement, the 3/2-way valve has a longitudinal tubular valve seat or valve body. A sliding sleeve is arranged on the valve seat. The sliding sleeve is in the form of a collar. The valve seat itself is designed so as to be laterally projecting from the tap-head body. This enables the sliding sleeve to slide away and back again on the valve seat with a simple manual operation, since the sliding sleeve may be grasped in several fingers of a user, and moved. The respective position of the sliding sleeve directly yields an instantaneous deduction as to its respective state. Either pressurisation gas is supplied to the keg, or the keg is degassed and the pressurisation-gas supply simultaneously interrupted rather than simple degassing or overpressure valve. In this case, although a keg is degassed, the supply of pressurisation gas is not simultaneously interrupted. The valve seat need not be designed so as to be projecting laterally from the tap-head body; it may also project beyond the upper surface of the tap-head body or jut laterally at an oblique angle. As mentioned, the sliding sleeve can thus be gripped in several fingers of the installer using it.

The slide valve is further designed in such a way that the sliding sleeve has two gaskets arranged as O-rings in an inner casing surface or in grooves of the inner casing surface of the sliding sleeve. The gaskets may also be in the form of an X-ring, piston seal or rod seal. With these two gaskets, the sliding sleeve is glidably mounted on the valve seat, and on the valve seat may be steplessly displaced into or out of two positions. A gas-tight channel is thereby formed between the two gaskets and between the outer casing surface of the valve seat and the inner casing surface of the sliding sleeve. The position of the channel can be altered by moving the the sliding sleeve accordingly. The gaskets may also be arranged on the valve seat.

In order now to create a gas-conducting connection, at least two radial boreholes aligned in a radial direction are provided within the valve seat, arranged spaced apart relative to one another in an axial direction. By displacement of the sliding sleeve, either both radial boreholes can thus be covered, therefore the radial boreholes are connected to one another by the gas-tight channel in a gas-conducting manner. By axial displacement of the sliding sleeve, the latter can assume a position (such) that one radial borehole is exposed to the environment, while the second radial borehole is covered. The exposed radial borehole is therefore able to discharge the internal pressure of the keg to the environment. The covered radial borehole is simultaneously connected to the channel in a gas-conducting manner, but on account of the position of the sliding sleeve the channel is gas-tightly closed, so that no gas can be released to the environment. In this way, for example, further supply of pressurisation gas through the 3/2-way valve is interrupted or sealed off, while simultaneously the interior space of the keg is degassed via the exposed radial borehole.

In an alternative variant embodiment, the valve seat may also have an axial through bore. This through bore can also be called a through-going axial borehole. In order that two connectors can now be gas-tightly separated from one another in an axial direction, a stopper is inserted into the through bore. The stopper is gas-tightly inserted into the through bore. To this end, the stopper is pressed into the through bore. The stopper may also be glued and/or screwed into the through bore. The through bore is thus divided into two portions, e.g., longitudinal portions, by the stopper. Within each portion, a radial borehole is then connected in a gas-conducting manner. With the assistance of the sliding sleeve, the 3/2-way valve can thus be formed and assume various positions.

The through bore has two longitudinal portions of diameters which differ from one another. Part of the longer portion with the smaller diameter is therefore formed between the radial boreholes. The stopper can thus be introduced through the longitudinal portion of larger diameter into the through bore and then, in the longitudinal portion of smaller diameter, be pressed into the part which lies between the two radial boreholes.

BRIEF DESCRIPTION OF THE DRAWINGS

Further advantages, features, characteristics and aspects of the present disclosure are the subject of the description which follows. Various exemplary embodiments are shown in the schematic drawings. These serve for an easier understanding of the disclosure. The drawings are as follows.

In the drawings, the same reference numbers are used for identical or similar components, even when for reasons of simplicity a description is not repeated.

DETAILED DESCRIPTION

Figure 1:
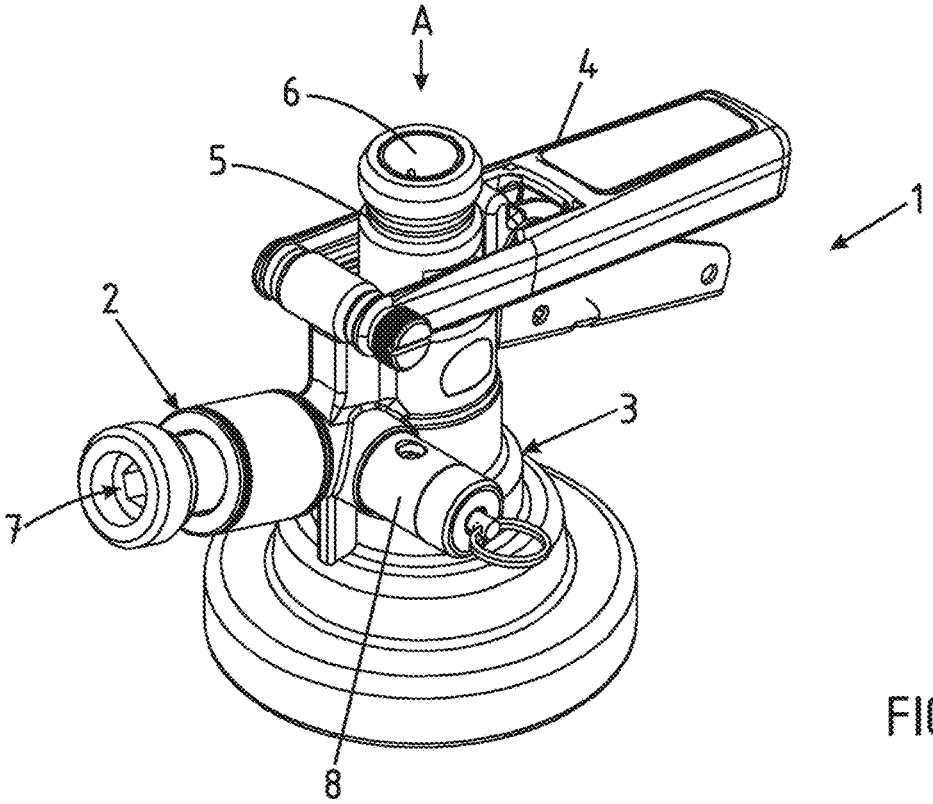
FIG. 1 A tap head according to the disclosure with 3/2-way valve, in perspective view, FIG. 2 A cross-sectional view through the tap head in the unlocked state, FIG. 3 A cross-sectional view of the tap head in the installed and locked state in gas-conducting position, FIG. 4 The tap head from FIG. 4 in degassing position, FIG. 5 An alternative variant embodiment to FIG. 3 with 3/2-way valve formed in one piece and of uniform material, FIGS. 6 and 7 Each show an enlarged cross-sectional view of the 3/2-way valve according to FIGS. 3 and. 4 respectively, FIGS. 8 and 9 The tap head with 3/2-way valve formed in one piece as a rotary valve, FIG. 10 The tap head with 3/2-way valve formed in one piece as a rotary valve and through bore, and FIG. 11 A variant embodiment of the 3/2-way valve as a slide valve with x-shaped seals.

FIG. 1 shows a tap head 1, with an installed 3/2-way valve 2 according to the disclosure. The tap head 1 has a tap-head body 3. A pivoted lever 4 is arranged on the tap-head body 3 itself. The pivoted lever 4 is capable of moving a tappet tube 5 disposed in the tap-head body 3, in axial direction A relative to the tap-head body 3. A beverage draw line 6 is formed in the tappet tube 5 itself. Further, a pressurisation-gas supply line 7 is formed, into which, as shown here, the 3/2-way valve 2 is incorporated by direct arrangement on the tap-head body 3. Further, a pressure-release or overpressure valve 8 may be provided, for the purpose of undertaking a further degassing function.

Figure 2:
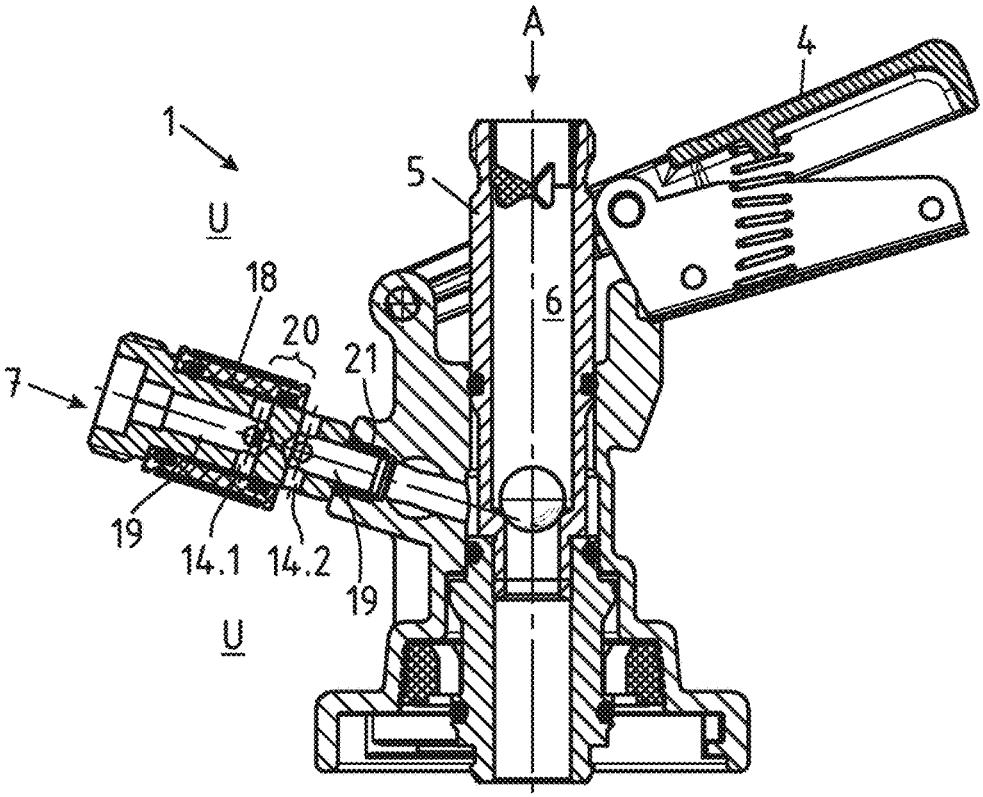
Figure 3:
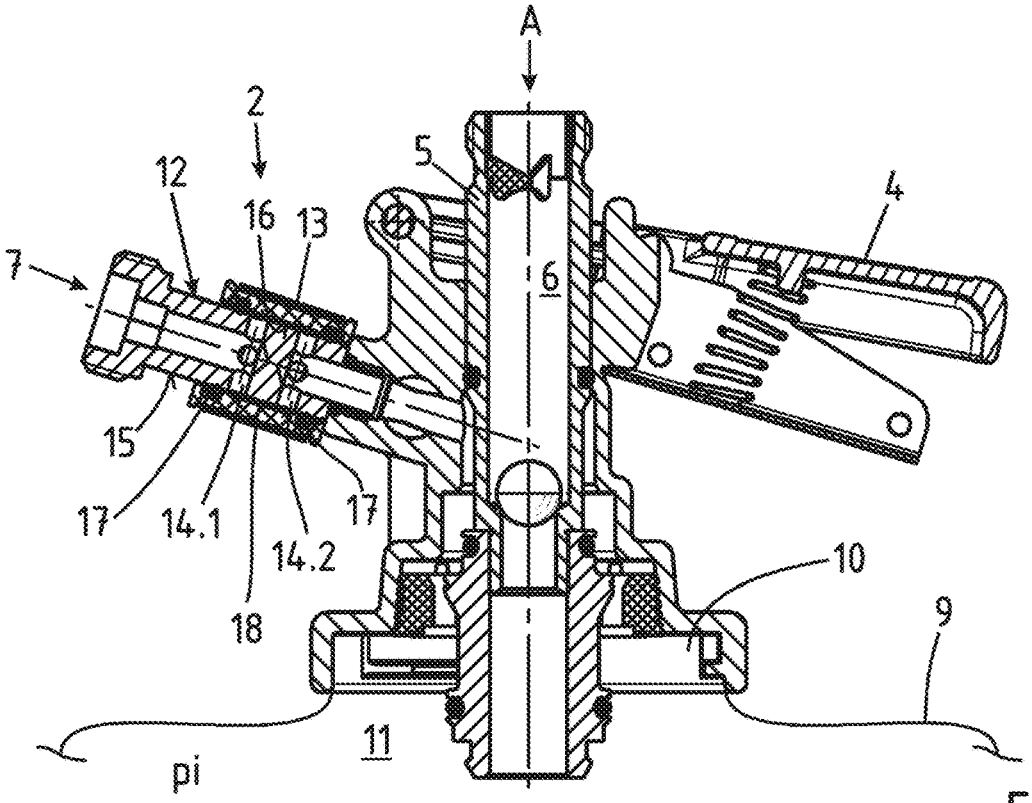
Figure 4:
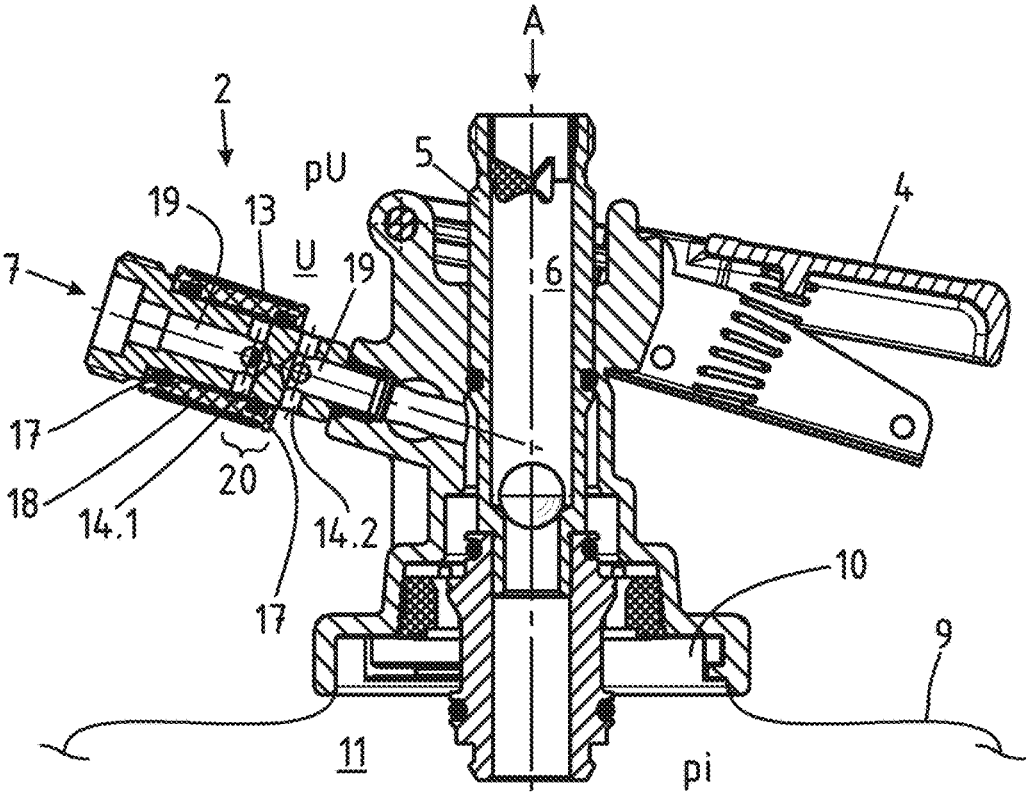
Figure 6:
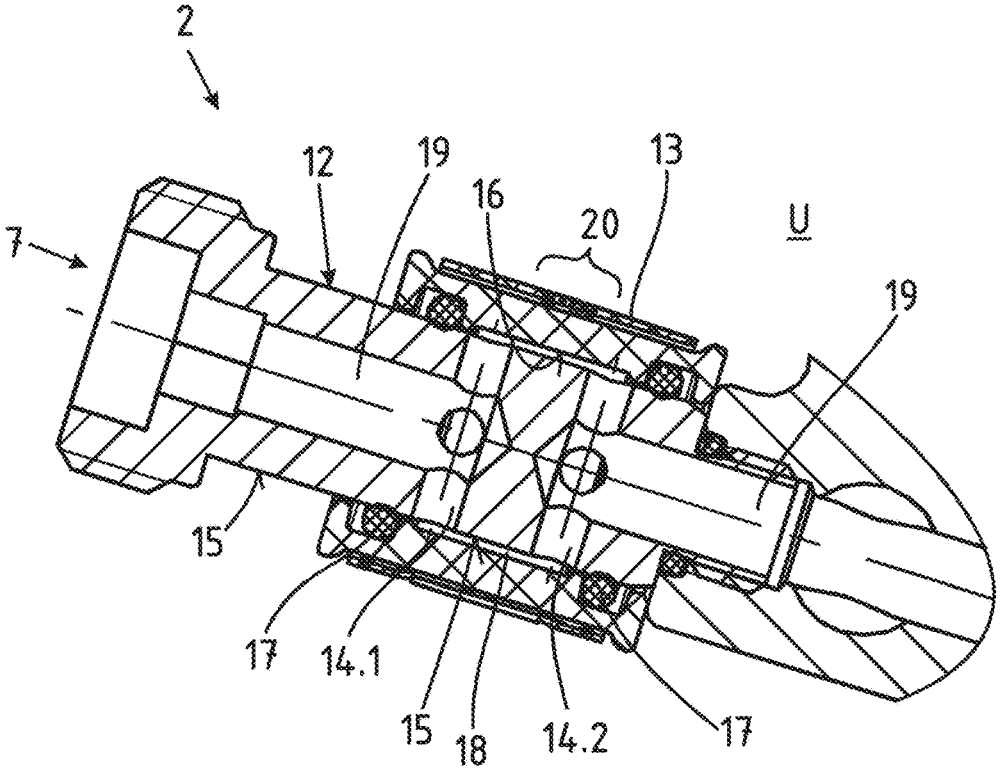

The variant embodiment according to the disclosure will now be elucidated in the cross-sectional views according to FIGS. 2, 3 and 4. According to FIG. 2 the tap-head body 3 is represented in an unlocked state. If the tap head 1 is now attached on a keg 9 according to FIGS. 3 and 4, said tap head 1 is associated with a keg head 10 depicted only schematically and not in detail and, through downward movement of the pivoted lever 4, the tappet tube 5 is moved in an axial direction A into the keg interior 11, that is, the interior chamber of the keg. By this means a pressurisation gas is introduced via the pressurisation-gas supply line 7 and enters the keg interior 11. An internal pressure pI is therefore present in the keg interior 11. The internal pressure pI corresponds to the set pressurisation-gas pressure. In order that the pressurisation gas can pass through the 3/2-way valve 2, a sliding sleeve 13 on a slide valve shown here with tubular or cylindrical valve seat 12 according to FIG. 3 is set in a transfer position. This means that the sliding sleeve 13 is displaced fully to the right referred to the plane of the drawing. At least two radial boreholes 14.1, 14.2 are provided in the valve seat 12. A gas-conducting channel 18 is formed in the 3/2-way valve 2 between an outer casing surface 15 of the valve seat 12, an inner casing surface 16 of the sliding sleeve 13 and between two gaskets 17 of the sliding sleeve 13 itself. Once again, this is shown in FIG. 6. In the position according to FIG. 3, the pressurisation gas, coming from the left referred to the plane of the drawing, can thus pass via the first radial borehole 14.1 into the channel 18 between valve seat 12 and sliding sleeve 13 and enter the right-hand radial borehole 14.1 referred to the image of the drawing, so that it arrives in the interior of the tap-head body 3 and from there in turn into the keg interior 11. This corresponds to the operation for tapping the beverage.

Should the keg 9 now have to be changed, the tap head 1 is in the first instance still positioned on the keg 9 and therefore in the locked position. However, the 3/2-way valve 2 has been reset in accordance with FIG. 4 and FIG. 7 so that the sliding sleeve 13 has been brought to the left referred to the plane of the drawing, into a degassing position. The first radial borehole 14.1 as before conducts the pressurisation gas, but is sealed off from the environment U owing to the pressure sealed design of the gas-conducting channel 18. While the pressurisation gas is in contact with the 3/2-way valve 2, it neither enters the keg interior 11, nor escapes to the environment U. Simultaneously, however, the overpressure in the keg interior 11 is discharged to the environment U via the second radial borehole 14.2, which is now exposed. A degassing function is therefore under way. The degassing is performed within a short period of, e.g., only a few seconds. Thus, immediately after moving the 3/2-way valve 2 into the degassing position, the tap head 1 can be unlocked and removed from the keg 9. The internal pressure pI then corresponds to the environmental pressure pU.

Two axial boreholes 19 are made in the valve seat 12, which boreholes are mechanically and physically separated from one another within a mid range 20. The pressurisation gas is conducted via the radial boreholes 14.1, 14.2 and the gas-conducting channel 18 from one axial borehole 19 into the next axial borehole 19. Two radial boreholes 14.1, 14.2 are furthermore present on each of the left and right sides. The channel 18 is of a radially circumferential design.

According to the variant embodiment in FIGS. 2, 3 and 4, the 3/2-way valve 2 is manufactured as a separate component, but is coupled to the tap-head body 3 as a direct result of positive locking on account of a threaded screw fitting 21. On the one hand the 3/2-way valve 2 is located directly on the tap head 1 itself, so that a user is also always required to use the 3/2-way valve 2 for degassing. Another exemplary embodiment is the possibility of separate manufacture of the 3/2-way valves 2 and therefore also of retrofitting to existing tap heads 1, as well as optionally of exchangeability in the case of servicing of the 3/2-way valves 2 to the tap head 1 itself.

Figure 5:
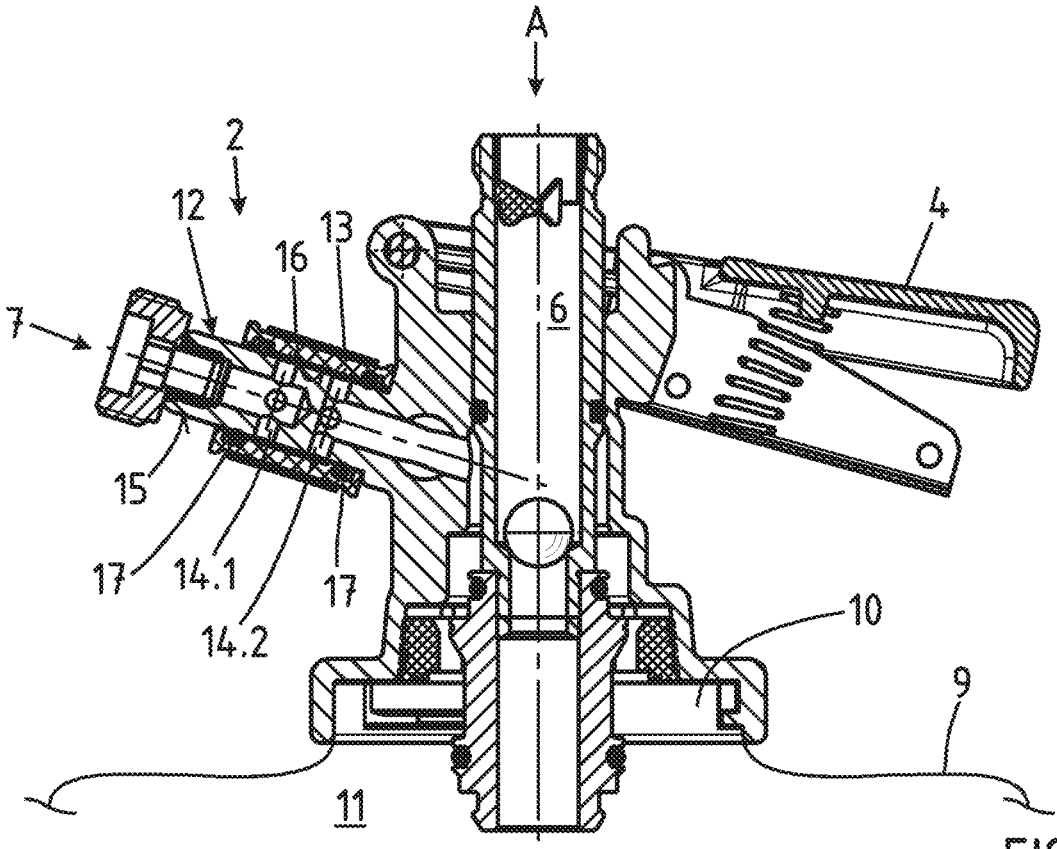

FIG. 5 shows an alternative variant embodiment. Here the valve seat 12 of the 3/2-way valves 2 is of a piece with and of the same material as the tap-head body 3 itself. However, the mode of operation is otherwise the same.

Figure 8:
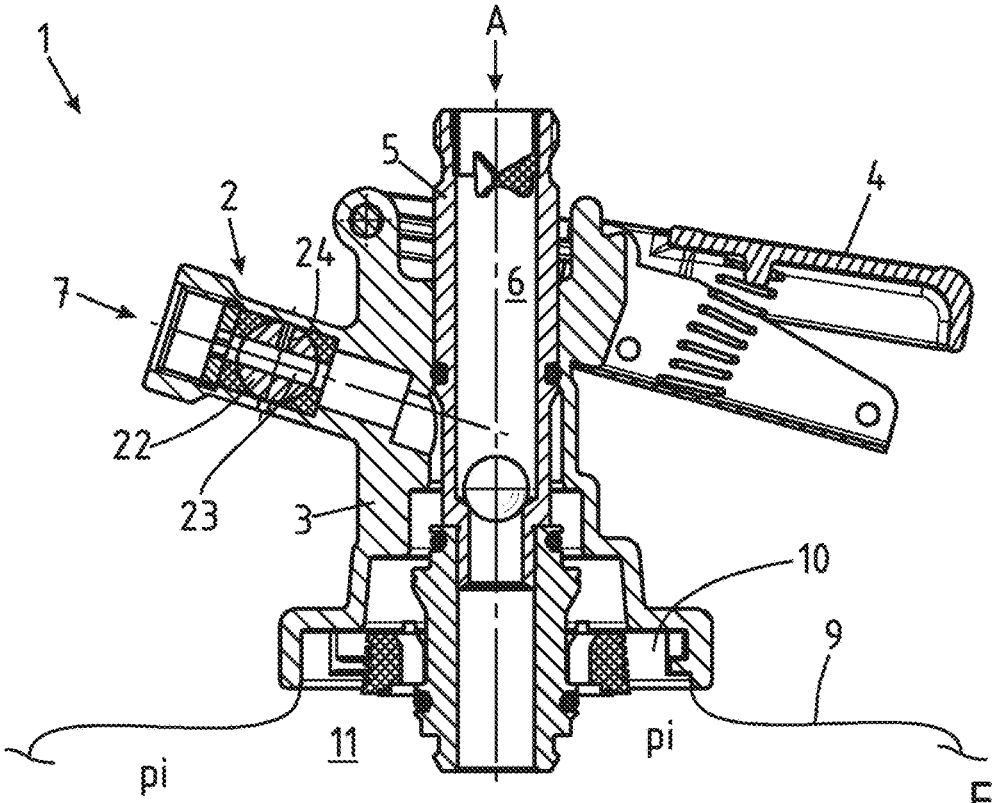
Figure 9:
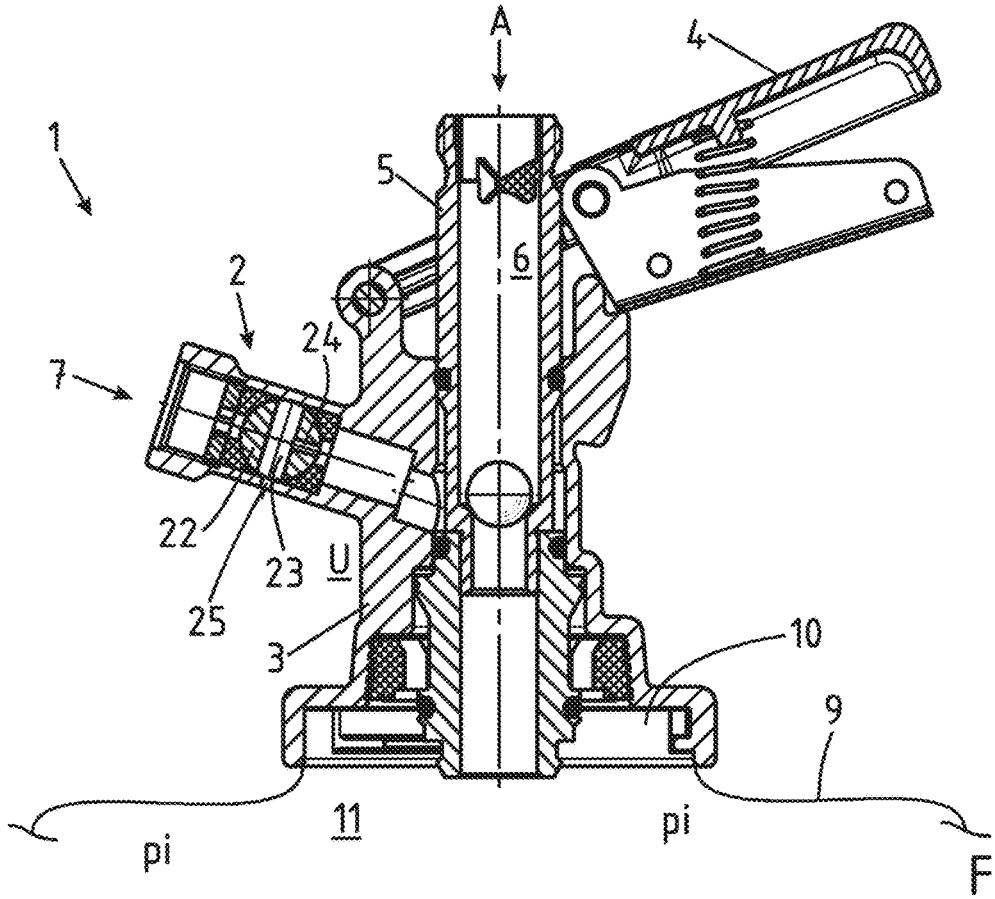

FIGS. 8 and 9 show a cross-sectional view of a tap head 1 analogous to FIGS. 3 and 4. However, they differ in that here too in accordance with FIG. 5 the 3/2-way valve 2 is of a piece with and of the same material as the tap-head body 3 itself. Furthermore, the 3/2-way valve 2 is in the form of a rotary valve. In this arrangement, the rotary valve can itself be in the form, for example, of a ball switching valve, but also a roller valve. Moreover, the ball 22, or the roller or shaft has a through bore 23 and a borehole 24 extending obliquely thereto. According to FIG. 8, the through bore 23 can, in the position set out of a keg 9, connect the keg interior 11 to the pressurisation-gas supply line 7.

In the position represented in FIG. 9, the through bore 23 blocks further supply of pressurisation gas via the pressurisation-gas supply line 7. Said through bore 23 also connects the keg interior 11 to the environment through the borehole 24. As a result, degassing can take place via an opening 25.

Figure 10:
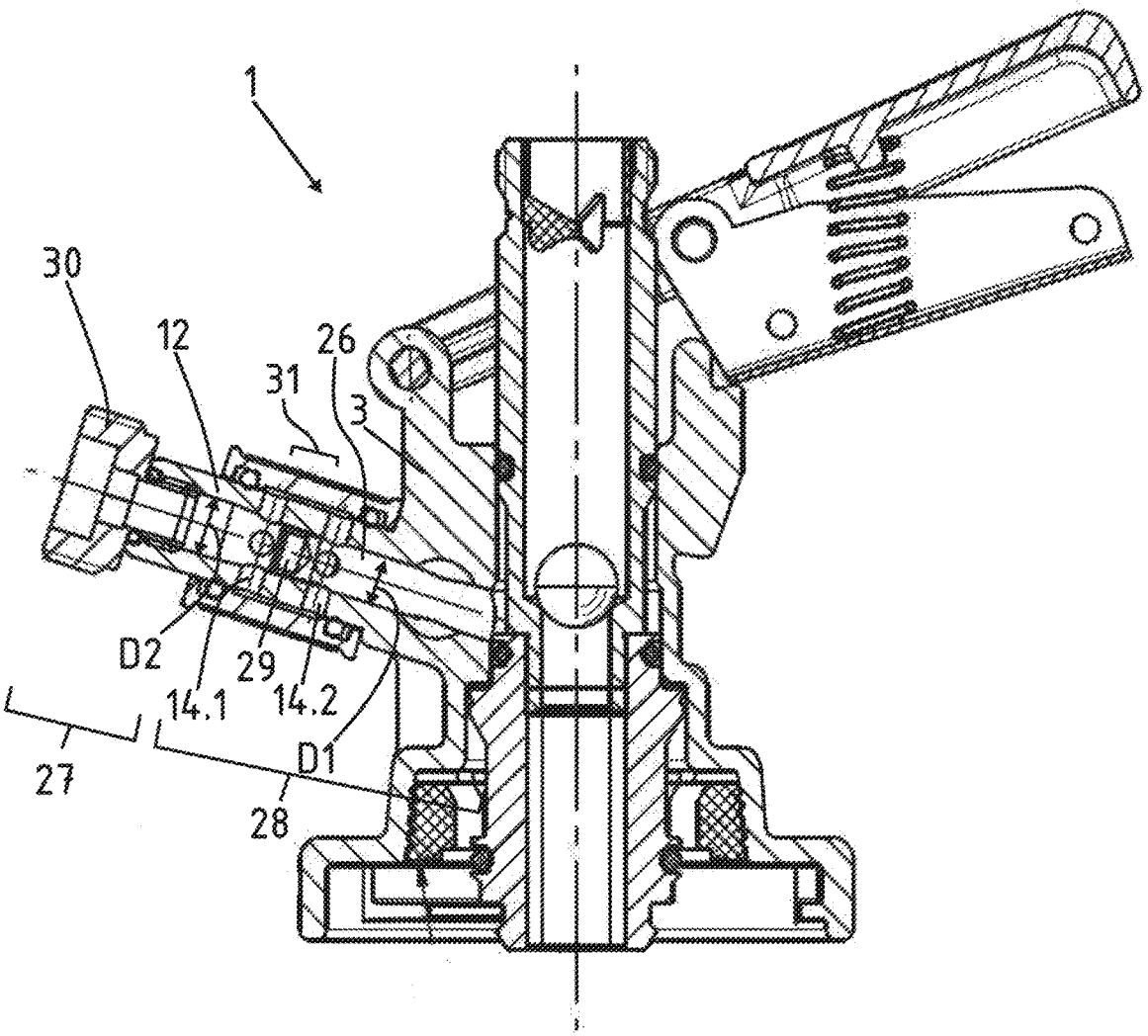

FIG. 10 shows the variant embodiment with the valve seat 12, which exhibits a through-going axial bore 26, or through bore. The valve seat 12 is of a piece with and of the same material as the tap-head body 3. The valve seat may however also be manufactured as a separate component and then coupled to the tap-head body 3. The through bore 26 exhibits two longitudinal portions 27, 28 of diameters D1, D2 that differ from one another. In this arrangement, a larger diameter D2 is depicted on the left referred to the plane of the drawing. A smaller diameter D1 is shown as being on the right side referred to the plane of the drawing. A stopper 29 has been inserted at the point where the smaller diameter begins. The stopper 29 is inserted in a part 31 of the longitudinal portion 28 of smaller diameter D1, which is arranged between the radial boreholes 14.1 and 14.2. The through-going axial borehole 26 having the two different diameters can thus be created. Thereafter the stopper 29, coming from the left side, can be inserted into the axial borehole 26. A press fit is then formed in this part between stopper 29 and axial borehole 26. A connector piece 30 for screw attachment of a gas line is then screwed into the valve seat.

Figure 7:
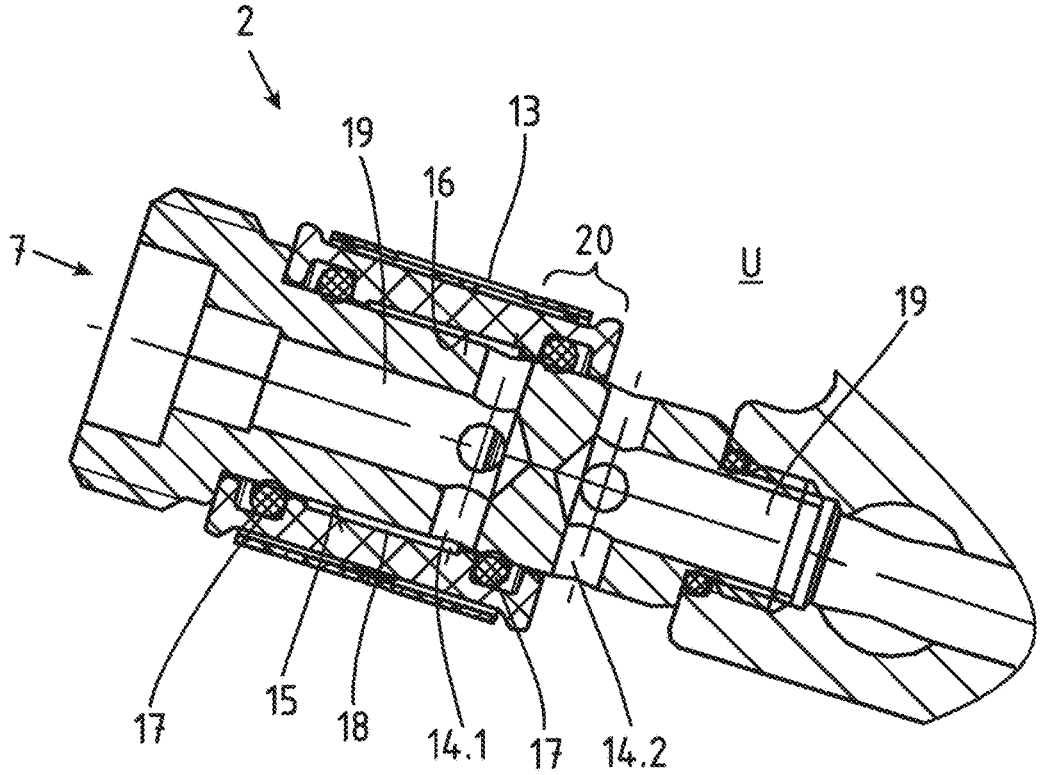
Figure 11:
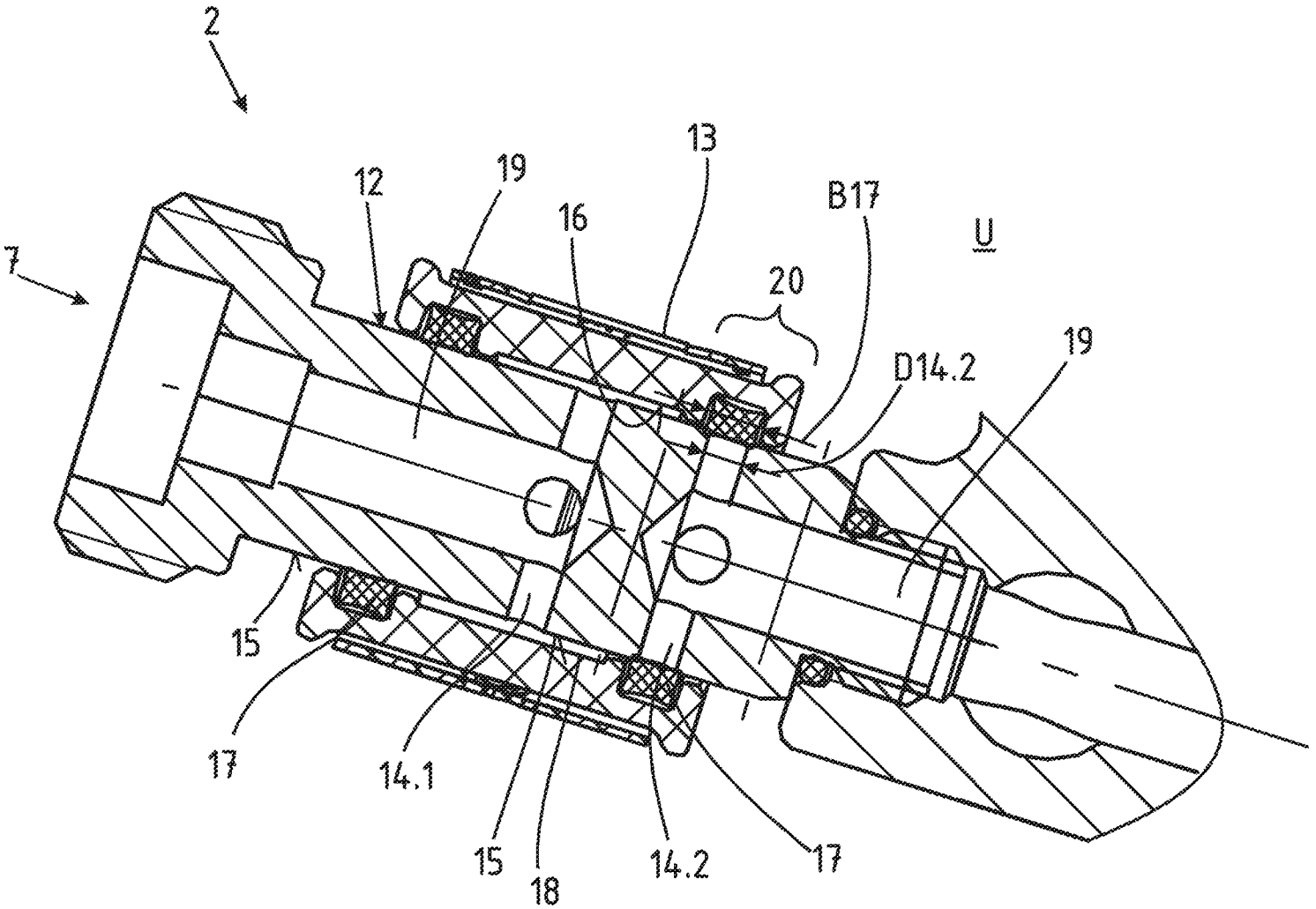

FIG. 11 shows an alternative variant embodiment to FIGS. 6 and 7. Here the gasket is not in the form of an O-ring, but of a cross-sectionally x-shaped gasket. It is an annular gasket which is x-shaped in cross section.

In another exemplary embodiment, the x-shaped gasket 12 has in cross-section a width B17, which is wider than the borehole diameter D14.2 of the radial borehole 14.2. An intermediate position is therefore taken up by the sliding sleeve 13. This means that the 3/2-way valve is not closed as shown in FIG. 6, nor open as shown in FIG. 7. If it is moved from the open position in FIG. 7 into a closed position in FIG. 6, not completely closed, but in the intermediate position or intermediate setting according to FIG. 11, the operator using it would be able to deduce, on the basis of the position of the sliding sleeve 13, that the sliding valve is in a closed position, since he or she can no longer see the borehole 14.2, because it is covered by the sliding sleeve 13. However, on this condition $CO_2$ gas could exit via the borehole 14.2 into the environment U, if it is only partially covered and/or is not closed on account of the cross section of an O-ring. However, because the width B17 of the x-shaped gasket 17 is greater than the diameter D14.2 of the radial borehole 14.2, this region is sure to be covered and thus sealed off from the environment. The gasket on the left referred to the plane of the drawing may also be x-shaped in cross section or be an O-ring. In the case of an O-ring, the glide resistance is reduced when the sliding sleeve is displaced.

The foregoing description of some embodiments of the disclosure has been presented for purposes of illustration and description. It is not intended to be exhaustive or to limit the disclosure to the precise form disclosed, and modifications and variations are possible in light of the above teachings. The specifically described embodiments explain the principles and practical applications to enable one ordinarily skilled in the art to utilize various embodiments and with various modifications as are suited to the particular use contemplated. It should be understood that various changes, substitutions and alterations can be made hereto without departing from the spirit and scope of the disclosure.

The invention claimed is:

1. A tap head for connecting to a keg in a bar system, the tap head comprising:

a tap-head body;

a pressurization-gas supply line;

a beverage draw line in the tap-head body; and a 3/2-way valve in the pressurization-gas supply line in the tap-head body, wherein the 3/2-way valve is configured to connect the pressurization-gas supply line from a gas source to an interior chamber of the keg or to connect the interior chamber of the keg to an environment in a gas-conducting manner, and wherein the 3/2-way valve has a valve seat on which a sliding sleeve is arranged, and the valve seat laterally juts from the tap-head body.

2. The tap head according to claim 1, wherein the 3/2-way valve comprises a slide valve.

3. The tap head according to claim 1, wherein the 3/2-way valve is coupled to the tap-head body with threaded screw fitting.

4. The tap head according to claim 1, wherein the 3/2-way valve has a valve seat comprising the same material as the tap-head body.

5. The tap head according to claim 1, wherein the sliding sleeve has two gaskets glidably mounted on the valve seat, and a gas-tight channel is between the two gaskets.

6. The tap head according to claim 1, wherein the valve seat has at least two radial boreholes aligned in a radial direction, and arranged axially spaced apart relative to one another, and by displacement of the sliding sleeve, both of the radial boreholes are covered.

7. The tap head according to claim 6, wherein the valve seat has two axial boreholes physically distanced from one another within a central region of the sliding sleeve, and the axial boreholes are connected to the radial boreholes in a gas-conducting manner.

8. The tap head according to claim 6, wherein the valve seat has a through-going axial borehole, a stopper is inserted between the two radial boreholes, and the stopper divides the through-going axial borehole into two longitudinal portions.

9. The tap head according to claim 8, wherein the two longitudinal portions have diameters that differ from one another, and a part of the longitudinal portion having the smaller diameter is between the two radial boreholes.

10. The tap head according to claim 1, wherein the sliding sleeve has two O-rings glidably mounted on the valve seat, and a gas-tight channel is between an outer casing surface of the valve seat and an inner casing surface of the sliding sleeve.

11. The tap head according to claim 1, wherein the valve seat has at least two radial boreholes aligned in a radial direction, and arranged axially spaced apart relative to one another, and by displacement of the sliding sleeve, one of the radial boreholes is exposed to the environment.

12. The tap head according to claim 1, wherein the sliding sleeve has two gaskets glidably mounted on the valve seat, and a gas-tight channel is between an outer casing surface of the valve seat and an inner casing surface of the sliding sleeve.

* * * * *